US008499587B1

(12) United States Patent
Hung

(10) Patent No.: US 8,499,587 B1
(45) Date of Patent: Aug. 6, 2013

(54) METHOD FOR KNITTING A WINDPROOF FABRIC

(75) Inventor: Jui-Ting Hung, Taipei (TW)

(73) Assignee: Eclat Textile Co., Ltd., Taipei (TW)

( * ) Notice: Subject to any disclaimer, the term of this patent is extended or adjusted under 35 U.S.C. 154(b) by 0 days.

(21) Appl. No.: 13/555,140

(22) Filed: Jul. 21, 2012

(51) Int. Cl.
*D04B 39/00* (2006.01)

(52) U.S. Cl.
USPC ..... 66/125 R; 66/202

(58) Field of Classification Search
USPC ..... 66/125 R, 136, 146, 202, 169 R, 66/170, 171
See application file for complete search history.

(56) References Cited

U.S. PATENT DOCUMENTS

| | | | | |
|---|---|---|---|---|
| 2,250,718 | A * | 7/1941 | McCloud | 33/662 |
| 5,094,006 | A * | 3/1992 | Varney | 33/563 |
| 5,244,716 | A * | 9/1993 | Thornton et al. | 428/198 |
| 6,845,638 | B2 * | 1/2005 | Ogata | 66/169 R |
| 7,509,823 | B2 * | 3/2009 | Chen | 66/202 |
| 2004/0116022 | A1 * | 6/2004 | Langley et al. | 442/289 |
| 2006/0030229 | A1 * | 2/2006 | Fukuoka et al. | 442/197 |
| 2007/0077840 | A1 * | 4/2007 | Chen et al. | 442/337 |
| 2009/0004428 | A1 * | 1/2009 | Renken et al. | 428/76 |

* cited by examiner

*Primary Examiner* — Danny Worrell

(57) ABSTRACT

A method for knitting a windproof fabric, wherein the fabric is knitted by a yarn which is made of two types of fibers which have different BWS values, so that the fabric knitted by this method is not only comfortable to wear, but also water resistant. Furthermore, the yarn is knitted at a predetermined knitting speed which is faster than the feeding speed, so as to increase the density of the knitted windproof fabric, and consequently achieving the function of windproof and water resistance.

7 Claims, 6 Drawing Sheets

METHOD FOR KNITTING A WINDPROOF FABRIC

BACKGROUND OF THE INVENTION

1. Field of the Invention

The present invention relates to a method for knitting a fabric, and more particularly to a method for knitting a windproof fabric.

2. Description of the Prior Art

The major methods for fabric manufacture are weaving and knitting. Woven fabric has the characteristics of high density, inelastic, starchy, and water resistant, while knitted fabric is low density, elastic, and soft and breathable. Different fabric manufacturing methods are used for different products. If clothes are made of woven fabric in order to be water resistant, the characteristics of high density and inelasticity of the woven fabric make the cloth relatively stiff and uncomfortable to wear. The knitted fabric 10, as shown in FIGS. 1 and 2, has a relatively low density due to the loops 11 are relatively long, which makes the knitted fabric 10 soft and comfortable to wear. However, the low density knitted fabric 10 is not resistant to water. Also because the loops 11 are relatively long, the knitted fabric is relatively loose and more likely to be damaged.

The present invention has arisen to mitigate and/or obviate the afore-described disadvantages.

SUMMARY OF THE INVENTION

The primary object of the present invention is to provide a method for knitting a windproof fabric, wherein the fabric is knitted by a yarn which is made of two types of fibers which have different BWS (boiling water shrinkage) values, so that the knitted fabric is not only comfortable to wear, but also water resistant.

Another object of the present invention is to provide a method for knitting a windproof fabric, wherein the yarn is knitted at a predetermined knitting speed which is faster than the feeding speed, so as to increase the density of the knitted windproof fabric, and consequently achieving the function of windproof and water resistance.

To achieve the above objects, a method for knitting a windproof fabric provided by the present invention comprises the following steps:

feeding a yarn at a predetermined feeding speed, the yarn being made of two types of fibers which have different boiling water shrinkage values, a first type of the fibers being a 15D~100D (Denier) polyester fiber with a BWS (boiling water shrinkage) value of 15~85%, and a second type of the fibers being 15D~100D polyester fiber with a BWS value of −15~+15%, or a 20D~160D Nylon fiber with a BWS value of −15~+15%;

knitting the yarn into a knitted windproof fabric at a predetermined knitting speed which is 5~35% faster than the feeding speed; and subjecting a surface of the knitted windproof fabric to a quality modification process.

The knitted windproof fabric comprises a plurality of loops which are tightly interlaced with one another, and has a warp density of 50~150 g/in, a weft density of 80~140 g/in, a weight of 60~210 g/SQM, and a loop length shrinkage of 3~25%.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
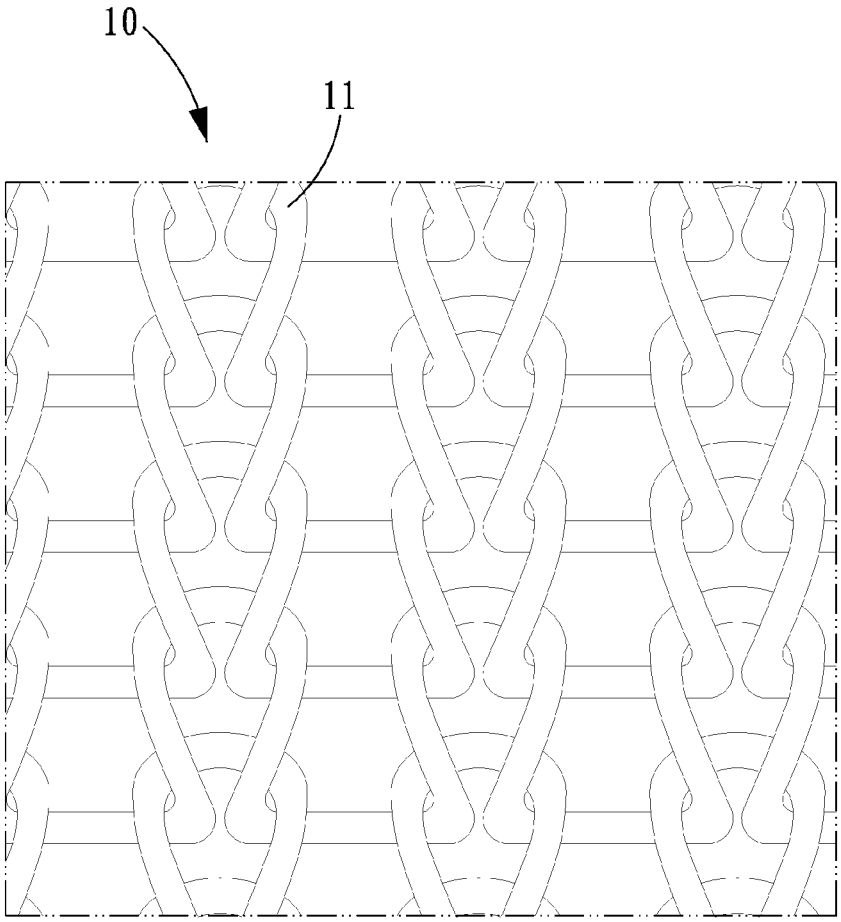
FIG. 1 PRIOR ART
FIG. 1 is an illustrative view of a conventional knitted fabric.
Figure 2:
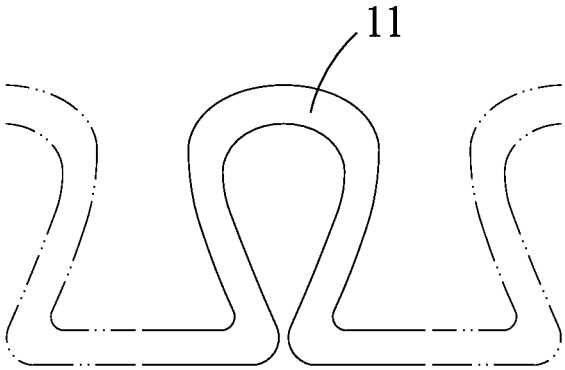
FIG. 2 PRIOR ART
FIG. 2 shows a loop of the conventional knitted fabric.
Figure 3:
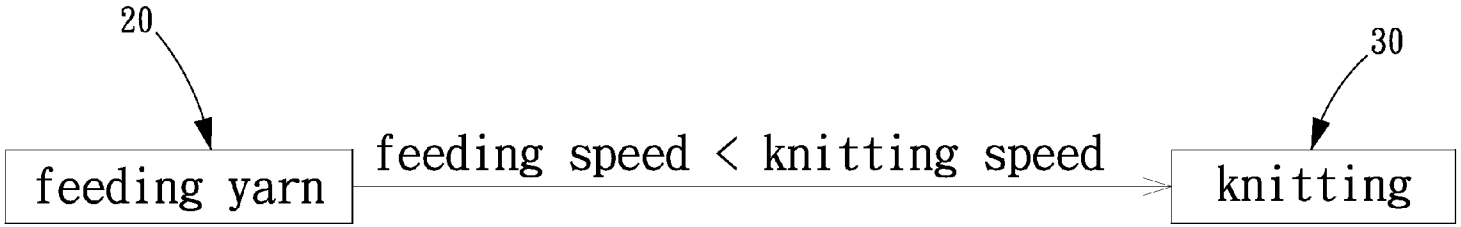
FIG. 3 is a flow chart showing the steps of a method for knitting a windproof fabric in accordance with the present invention.

Referring to FIG. 3, a method for knitting a windproof fabric in accordance with the present invention comprises the following steps:

Feeding yarn 20: wherein yarn is fed from a yarn storage device at a predetermined feeding speed;

Knitting 30: using a fine gauge knitting machine to knit the yarn into a windproof fine gauge knitted fabric which is tightly knitted and includes a plurality of loops, wherein the yarn is knitted at a predetermined knitting speed which is 5~35% (optimally 20%) faster than the feeding speed, so that the length of the loops of the knitted windproof fabric is reduced, and the density of the knitted windproof fabric is also improved.

The yarn is made of two types of fibers which have different BWS values (boiling water shrinkage), a first fiber is 15D~100D (Denier) polyester fiber with a boiling water shrinkage of BWS value of 15~85%, and a second fiber is 15D~100D polyester fiber with a BWS value of −15~+15%, or a 20D~160D Nylon fiber with a BWS value of −15~+15%.

The first and second fibers are mixed at a predetermined weight (or volume) ratio, for example, at the ratio of 1:1.5~1:10.5. The first and second fibers are a long fiber and a short fiber, respectively, and mixed in such a manner that the long fiber is a core, and the short fiber wraps the long fiber up, or, the short fiber is a core and wrapped up by the long fiber, so as to make the physical property of the yarn fall in between the physical properties of the two types of fibers which form the yarn (the yarn formed by the two different fibers is endowed with the physical properties of both fibers. Adjusting the ratio between the two fibers can make the property of the yarn close to the physical property of the long fiber or the short fiber.

The specification of the windproof fine gauge knitted fabric is listed as follows: warp density: 50~150 g/in, weft density: 80~140 g/in, weight: 60~210 g/SQM, and loop length shrinkage: 3~25%.

The windproof fine gauge knitted fabric is a single layer or double layer flannel or brushed fabric and treated with quality modification process to meet the quality requirements of ISO 9237, and the wind pressure resistance performance and the breathability of the fine gauge knitted fabric are 100PA, and 50~100 $cm^3/cm^2/s$, respectively.

Figure 4:
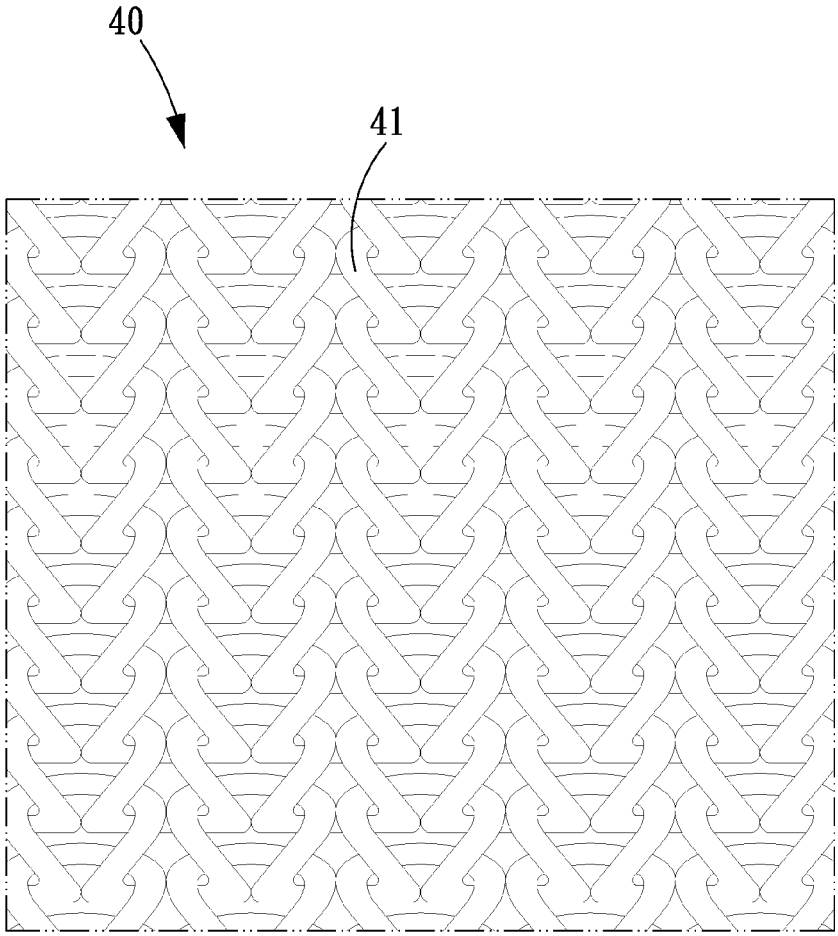
FIG. 4 is an illustrative view a knitted fabric knitted by the method of the present invention.
Figure 5:
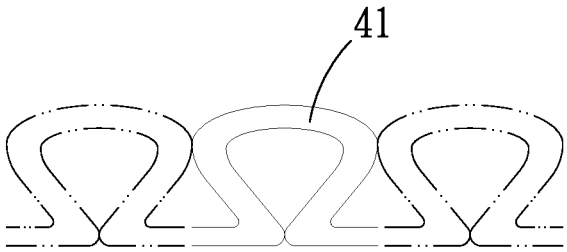
FIG. 5 shows a loop of the knitted fabric knitted by the method of the present invention.

The windproof fine gauge knitted fabric 40, as shown in FIGS. 4 and 5, comprises a plurality of loops 41 which are tightly interlaced with one another, so that the intervals among the loops 41 are reduced to a certain extent to make the knitted windproof fabric 40 water resistant and windproof.

In according to the method of the present invention, since the yarn is fed at relatively low feeding speed, the length of every loop 41 of the knitted windproof fabric 40 will be reduced, and so will be the density of the loops 41 of the knitted windproof fabric 40. Since the knitted windproof fabric 40 is a knitted structure, it is soft, elastic and comfortable to wear. Furthermore, the present invention changes the proportion of the yarning feeding speed and the knitting speed, so as to increase the density of the loops 41 of the knitted windproof fabric 40, and consequently makes the knitted windproof fabric 40 windproof and even water resistant. Since the length of the loops 41 of the knitted windproof fabric 40 is reduced, the surface of the knitted windproof fabric 40 will become more tight and smooth, so as to prevent fabric pilling, and consequently extending the service life of the knitted windproof fabric 40.

Figure 6:
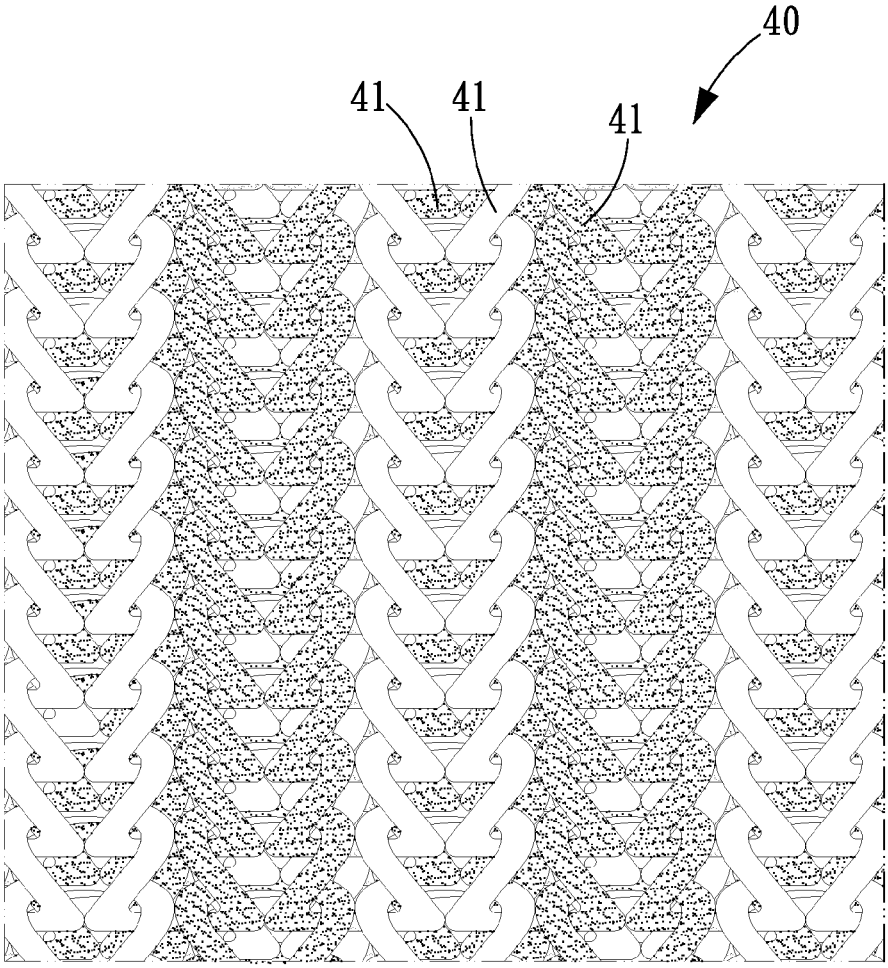
FIG. 6 is an illustrative view another knitted fabric knitted by the method of the present invention.

The abovementioned knitted windproof fabric 40 is a single jersey fabric, and it can also be a double jersey fabric, as shown in FIG. 6.

To make the structure of the fabric more stable, the knitted windproof fabric 40 formed after the step of knitting 30 can be subjected to a quality modification process, which is a heating process used to heat the knitted windproof fabric 40, so that the surface of the knitted windproof fabric 40 will be firstly melted and then cured after the heating process, and will accordingly become less elastic and more stable, while the density of the knitted windproof fabric 40 doesn't change. Hence, one surface of the knitted windproof fabric 40 can be subjected to the quality modification process to provide a better windproof and water resistance performance, and this surface of the knitted windproof fabric 40 subjected to the quality modification process can be used as an external surface, while the other surface of the knitted windproof fabric 40 which is not subjected to the quality modification process can be used as an inner surface which is to be in contact with the wear's skin to provide better wearing comfort.

The quality modification process is to heat the knitted windproof fabric 40 at 190~205° C. for 1~5 seconds, so as to make the knitted windproof fabric 40 meet the quality requirements of ISO 9237, and the wind pressure resistance performance and the breathability of the fine gauge knitted fabric are 100PA and 3~50 $cm^3/cm^2/s$, respectively. Furthermore, the knitted windproof fabric 40 is water passes the AATCC35 rain test.

The present invention is aimed at providing a method for knitting a windproof fabric, and the test data of the fabrics knitted by the method of the present invention are as shown in table 1, wherein the breathability of the respective fabrics ranges 3~50 $cm^3/cm^2/s$, which means that all the fabrics are windproof. The fabrics with the reference numbers: R6033, R6267, R0091, R1268 and R2156 all have a water permeability less than 1 g, which means that these fabric are water resistant.

The fabric knitted by the method of the present invention has the following advantages over the existing windproof fabric available on the market:

1, lightweight, the test data as shown in table 2 shows that the fabrics (which weigh:126~190 g/SQM) knitted by the method of the present invention is 30~40% lighter than the existing windproof fabrics which mostly weigh 190~347 g/SQM.

2, simplified manufacturing process: through the improved fabric density and the quality modification process, the knitted fabric of the present invention achieves the function of windproof and water resistance. Hence, the manufacturing process of the present invention is obviously simplified, low cost and environmentally friendly, as compared to the conventional method of using chemical coating to improve windproof performance.

3. the existing commercially available windproof clothing made of coated fabric will produce friction noise when it is worn and the different parts of the clothing rub against each other. However, there is no coating on the surface of the knitted fabric of the present invention, so the clothing made of the knitted fabric of the present invention doesn't have the problem of friction noise when being worn.

While we have shown and described various embodiments in accordance with the present invention, it is clear to those skilled in the art that further embodiments may be made without departing from the scope of the present invention.

TABLE 1

Test data of the windproof fabric of the present application

| test No. | color | fabric processing | SQM | breathability test Cm/sq.cm/sec | rain test (deemed as "PASS" when water permeability is less than 1 g) | initial water spray test | water spray test washed 20 times |
|---|---|---|---|---|---|---|---|
| R6033 | black | single jersey | 181 | 3 | 0.1 | 100 | 80 |
| R6267 | black | single jersey | 126 | 3.9 | 0.1 | 100 | 80 |
| R0091 | Leopard | three-layer lamination | 159 | 0 | 0.1 | 100 | 90 |
| R1268 | coffee | interlock | 174 | 10.4 | 0.2 | 100 | 80 |
| R2156 | coffee | interlock | 190 | 6 | 0.1 | 100 | 70 |
| R6034 | black | single jersey | 129 | 40.3 | 8.1 | 100 | 80 |
| R6128 | black | single jersey | 169 | 28.9 | 8.7 | 100 | 80 |
| R6128 | Rose | single jersey | | 21.1 | 8.3 | 100 | 80 |
| R6129 | Apple green | single jersey | 169 | 19.9 | 7.8 | 100 | 70 |
| R6129 | black | single jersey | | 16.1 | 15.4 | 100 | 70 |
| R6199 | Apple green | single jersey | 177 | 14.5 | 4.9 | 100 | 80 |
| R9061 | bright yellowish brown | single jersey | 174 | 14.6 | 4.9 | 100 | 70 |
| R1039 | carbon black | interlock | 150 | 16.1 | 1.6 | 100 | 70 |
| R1267 | Dark brown | interlock | 150 | 16.2 | 1.1 | 100 | 90 |

TABLE 2

Test data of other commercially available brands

| test No. | color | fabric processing | SQM | breathability test Cm/sq.cm/sec | rain test (deemed as "PASS" when water permeability is less than 1 g) | initial water spray test | water spray test washed 20 times |
|---|---|---|---|---|---|---|---|
| A01 | black | three-layer lamination | 190 | 1.47 | 0 | — | — |
| B02 | khaki/black | two-layer lamination | 285 | 97.2 | >5 | — | — |
| C03 | gray/blue | two-layer lamination | 203 | 51.59 | >5 | — | — |
| D04 | blue/gray | two-layer lamination | 347 | 58.09 | 0.1 | — | — |
| E05 | black | three-layer lamination | 250 | 57.8 | >5 | 0 | 0 |

What is claimed is:

1. A method for knitting a windproof fabric comprising the following steps:

feeding a yarn at a predetermined feeding speed, the yarn being made of two types of fibers which have different boiling water shrinkage values, a first type of the fibers being a 15 Denier~100 Denier polyester fiber with a boiling water shrinkage value of 15~85%, and a second type of the fibers being 15 Denier~100 Denier polyester fiber with a boiling water shrinkage value of −15~+15%, or a 20Denier~160 Denier Nylon fiber with a boiling water shrinkage value of −15 +15%;

knitting the yarn into a knitted windproof fabric at a predetermined knitting speed which is 5~35% faster than the feeding speed; and subjecting a surface of the knitted windproof fabric to a quality modification process.

2. The method for knitting a windproof fabric as claimed in claim 1, wherein the first and second fibers are a long fiber and a short fiber, respectively, and mixed in such a manner that the long fiber is a core, and the short fiber wraps the long fiber up, or, the short fiber is a core and wrapped up by the long fiber.

3. The method for knitting a windproof fabric as claimed in claim 2, wherein the first and second fibers are mixed at a predetermined weight or volume ratio of 1:1.5~1:10.5.

4. The method for knitting a windproof fabric as claimed in claim 1, wherein the yarn is knitted at a predetermined knitting speed which is 20% faster than the feeding speed.

5. The method for knitting a windproof fabric as claimed in claim 1, wherein the quality modification process is a heating process.

6. The method for knitting a windproof fabric as claimed in claim 5, wherein the quality modification process is to heat the knitted windproof fabric at a temperature of 190~205° C. for 1~5 seconds, so as to make the knitted windproof fabric meet the quality requirements of ISO 9237, and a wind pressure resistance performance and a breathability of the fine gauge knitted fabric are 100PA and 3~50 $cm^3/cm^2/s$, respectively.

7. The method for knitting a windproof fabric as claimed in claim 1, wherein the knitted windproof fabric comprises a plurality of loops which are tightly interlaced with one another, and has a warp density of 50~150 g/in, a weft density of 80~140 g/in, a weight of 60~210 g/SQM, and a loop length shrinkage of 3~25%.

* * * * *